US009919720B2

(12) United States Patent
Yanobu et al.

(10) Patent No.: US 9,919,720 B2
(45) Date of Patent: Mar. 20, 2018

(54) BOGIE AND TRACK-TYPE VEHICLE

(71) Applicant: MITSUBISHI HEAVY INDUSTRIES, LTD., Tokyo (JP)

(72) Inventors: Yukihide Yanobu, Tokyo (JP); Hiroyuki Kono, Tokyo (JP); Akihisa Kawauchi, Tokyo (JP); Kousuke Katahira, Tokyo (JP); So Tamura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 168 days.

(21) Appl. No.: 15/031,528

(22) PCT Filed: Oct. 20, 2014

(86) PCT No.: PCT/JP2014/077808
§ 371 (c)(1),
(2) Date: Apr. 22, 2016

(87) PCT Pub. No.: WO2015/079826
PCT Pub. Date: Jun. 4, 2015

(65) Prior Publication Data

US 2016/0257315 A1 Sep. 8, 2016

(30) Foreign Application Priority Data

Nov. 28, 2013 (JP) ..... 2013-246037

(51) Int. Cl.
*B61F 5/38* (2006.01)
*B61B 13/04* (2006.01)
(Continued)

(52) U.S. Cl.
CPC ..... *B61F 5/38* (2013.01); *B61B 13/04* (2013.01); *B61F 3/16* (2013.01); *B61F 5/148* (2013.01); *B61F 5/46* (2013.01)

(58) Field of Classification Search
CPC .... B61F 5/38; B61F 5/148; B61F 5/46; B61F 5/52; B61F 5/10; B61F 5/50; B61F 9/00;
(Continued)

(56) References Cited

U.S. PATENT DOCUMENTS 6,477,963 B1 11/2002 Weule et al.
2011/0265683 A1* 11/2011 Kurahashi ..... B61B 10/04 105/215.2
(Continued)

FOREIGN PATENT DOCUMENTS

JP S55-055052 A 4/1980
JP S58-081857 A 5/1983
(Continued)

OTHER PUBLICATIONS

PCT/ISA/210, "International Search Report for International Application No. PCT/JP2014/077808," dated Jan. 13, 2015.
(Continued)

*Primary Examiner* — Jason C Smith
(74) *Attorney, Agent, or Firm* — Manabu Kanesaka; Benjamin Hauptman; Kenneth Berner

(57) ABSTRACT

This traveling bogie is provided with: steered wheels; a main body for supporting the steered wheels; a guide device turning when subjected to a reaction force from a guide rail; a steering mechanism for applying a steering force to the steered wheels utilizing the reaction force applied to the guide device; and an assist mechanism for applying an assist steering force to the steered wheels, the assist steering force assisting the steering force applied by the steering mechanism. The assist mechanism is provided with: a first operation arm pivoting together with the steered wheels in the direction in which the steered wheels are steered; a second operation arm rotating about a rotation axis relative to the main body in response to the turning of the guide device; and
(Continued)

an elastically deformable section connected to the first operation arm and the second operation arm and elastically deformable.

6 Claims, 5 Drawing Sheets

(51) Int. Cl.
*B61F 5/46* (2006.01)
*B61F 3/16* (2006.01)
*B61F 5/14* (2006.01)

(58) Field of Classification Search
CPC . B61F 3/26; B61B 13/04; B60C 11/24; B60C 7/00
See application file for complete search history.

(56) References Cited

U.S. PATENT DOCUMENTS

2011/0271868 A1* 11/2011 Kurahashi ..... B61B 10/04 105/141
2012/0017800 A1* 1/2012 Kurahashi ..... B61B 10/04 105/182.1
2012/0031298 A1* 2/2012 Kurahashi ..... B61B 10/04 105/215.2
2012/0097065 A1* 4/2012 Maeyama ..... B62D 1/265 105/177
2012/0103227 A1* 5/2012 Maeyama ..... B61B 13/00 104/245
2015/0314796 A1* 11/2015 Maeyama ..... B61B 13/04 701/19
2015/0353104 A1* 12/2015 Maeyama ..... B61B 13/00 701/19
2015/0353106 A1* 12/2015 Maeyama ..... B62D 1/265 74/89.14
2016/0052529 A1* 2/2016 Tachibana ..... B61B 13/00 105/215.1
2016/0069033 A1* 3/2016 Katahira ..... E01H 5/092 104/279
2016/0207548 A1* 7/2016 Katahira ..... B61B 13/00
2016/0251002 A1* 9/2016 Katahira ..... B61B 13/00 105/182.1
2016/0257315 A1* 9/2016 Yanobu ..... B61F 5/38
2016/0264156 A1* 9/2016 Yanobu ..... B61B 13/04
2016/0272222 A1* 9/2016 Katahira ..... B61B 13/00
2016/0355059 A1* 12/2016 Katahira ..... B61F 9/00
2017/0158210 A1* 6/2017 Katahira ..... B61F 5/52

FOREIGN PATENT DOCUMENTS

JP 2007-216815 A 8/2007
JP 2010-195310 A 9/2010
JP 2010-215120 A 9/2010
WO 2010-109684 A1 9/2010

OTHER PUBLICATIONS

PCT/ISA/237, "Written Opinion of the International Searching Authority for International Application No. PCT/JP/2014/077808," dated Jan. 13, 2015.

* cited by examiner

BOGIE AND TRACK-TYPE VEHICLE

TECHNICAL FIELD

The present invention relates to a bogie and a track-type vehicle.

Priority is claimed on Japanese Patent Application No. 2013-246037, filed Nov. 28, 2013, the content of which is incorporated herein by reference.

BACKGROUND ART

As new transportation means other than buses or railroads, track-based transportation systems that travel on a track by means of traveling wheels consisting of rubber tires are known. These types of track-based transportation systems are generally referred to as "new transportation systems", "automated people movers (APMs)", or the like. In the track-based transportation systems, guide wheels disposed at both side parts of a vehicle or the like are guided by guide rails provided along a track.

In the vehicle of the above-described track-based transportation systems, the traveling wheels and the guide wheels are provided in a bogie disposed in a lower part of the vehicle. The bogie includes a mechanism that steers a traveling wheel (steered wheel), using a force (reaction force) with which a guide wheel is pressed against a guide rail when the vehicle passes through a curved portion (for example, refer to PTL 1). A bogie including a guide device that has a guide wheel and is turnably attached to the vehicle, and a steering mechanism (tie rod or tie-rod arm) that steers a steered wheel according to the turning of the guide device is disclosed in PTL 1.

CITATION LIST

Patent Literature

[PTL 1] Japanese Unexamined Patent Application Publication No. 2010-195310

SUMMARY OF INVENTION

Technical Problem

In recent years, an increase in the withstand load of a vehicle, an increase in the speed of a track-based transportation system, and the like are required, and it is considered that wide traveling wheels are used with this.

However, if the width dimension of the steered wheels becomes large, the frictional force between a steered wheel and the track, the amount of kingpin offset, self aligning torque, and the like become large. Therefore, a force required for the steering of the steered wheel becomes large. That is, when the steered wheel is steered, a reaction force that the guide device receives from a guide rail becomes large.

Meanwhile, since there are limitations on the strength and durability of the guide device or the guide rail, when the steered wheel is steered, there is also a limitation to the magnitude of the reaction force that the guide device receives from the guide rail.

The invention provides a bogie and a track-type vehicle that can steer a wide steered wheel while suppressing a reaction force that a guide device receives to be small.

Solution to Problem

According to a first aspect of the invention, a bogie is a bogie that travels while being guided by a guide rail provided along a track. The bogie includes a steered wheel; a main body that supports the steered wheel; a guide device that is supported so as to be turnable with respect to the main body and turns under a reaction force from the guide rail; a steering mechanism that applies a steering force to the steered wheel using the reaction force that the guide device has received; and an assist mechanism that applies an assist steering force, which assists the steering force applied by the steering mechanism, to the steered wheel. The assist mechanism includes a first operation arm that pivots in a steering direction of the steered wheel together with the steered wheel, a second operation arm that is attached so as to be rotatable around a rotation axis with respect to the main body, is coupled to the guide device, and rotates around the rotation axis according to the turning of the guide device, and an elastically deformable section that is coupled to the first operation arm and the second operation arm and is elastically deformable with a change in relative distance between the first operation arm and the second operation arm. A distance from the rotation axis to a coupling portion of the second operation arm with the guide device is longer than a distance from the rotation axis to a coupling portion of the second operation arm with the elastically deformable section.

When the bogie having the above configuration travels along a curved portion of the track, the guide device is pressed against the guide rail, and thereby, the guide device turns under a reaction force from the guide rail. Additionally, as a steering force using the aforementioned reaction force is applied to the steered wheel by the steering mechanism, the steered wheel can be directed to a traveling direction of the bogie along the curved portion of the track.

In the bogie having the above configuration, when the steered wheel is steered by the steering mechanism, the second operation arm rotates the rotation axis with the turning of the guide device. Accordingly, a force (rotative force) that rotates the second operation arm around the rotation axis is applied to the second operation arm. Here, the distance from the coupling portion of the second operation arm with the guide device to the rotation axis is longer than the distance from the coupling portion of the second operation arm with the elastically deformable section to the rotation axis. For this reason, when the second operation arm rotates and the relative distance between the second operation arm and the first operation arm varies, a greater force than the above rotative force acts on the elastically deformable section, and the elastically deformable section is elastically deformed. The elastic force of the elastically deformable section that is elastically deformed is transmitted to the first operation arm and is thereby applied to the steered wheel as the assist steering force. Additionally, since the reaction force of the assist steering force (elastic force) that the second operation arm receives from the elastically deformable section is received by the main body via the rotation axis of the second operation arm, the assist steering force can be efficiently applied to the steered wheel while reducing the reaction force that the guide device receives from the guide rail.

As described above, as the assist steering force of the assist mechanism is applied to the steered wheel, it is possible to steer the steered wheel while suppressing the reaction force that the guide device receives from the guide rail to be small.

According to a second aspect of the invention, in the bogie of the first aspect, a coupling portion of the second operation arm with the elastically deformable section may be located between a coupling portion of the second operation arm with the guide device, and the rotation axis.

According to the above configuration, the length of the second operation arm can be set to be short, and miniaturization of the assist mechanism can be achieved.

According to a third aspect, in the bogie of the first or second aspect, the guide device may further include a turning arm that is attached so as to be turnable around a turning axis with respect to the main body, and a distance from the turning axis to a coupling portion of the turning arm with the second operation arm may be longer than a distance from the turning axis to a coupling portion of the turning arm with the steering mechanism.

According to the bogie having the above configuration, the movement (rotational angle) of the second operation arm with respect to the turning angle of the turning arm becomes greater than the movement of the steering mechanism. Therefore, it is possible to set the assist steering force applied by the assist mechanism to be larger. Therefore, the steered wheel can be steered, while suppressing the reaction force that the guide device receives from the guide rail to be smaller.

Moreover, as the movement of the steering mechanism with respect to the turning angle of the turning arm becomes small, it is also possible to precisely adjust the steering angle of the steered wheel.

According to a fourth aspect of the invention, in the bogie of any one aspect of the first to third aspects, the elastically deformable section may not be elastically deformed in a case where the steering angle of the steered wheel from a straight-running state is equal to or smaller than a predetermined angle.

According to the bogie having the above configuration, if the guide device receives a minute reaction force from the guide rail and the steering angle of the steered wheel accompanying this is equal to or smaller than a predetermined angle when the bogie travels along a linear portion of the track, the elastically deformable section is not elastically deformed even if the second operation arm rotates around the rotation axis. Therefore, the assist steering force is not applied to the steered wheel. For this reason, even if the guide device receives the reaction force and the steered wheel is steered when the bogie travels along the linear portion of the track, it is possible to return the steered wheel to a straight-running state rapidly with self-aligning torque. Therefore, the bogie can travel in a stable state in the linear portion of the track.

According to a fifth aspect of the invention, in the bogie of any one aspect of the first to fourth aspects, the steering mechanism may include an elastic member that couples the steered wheel and the guide device, and is elastically deformable.

According to the bogie having the above configuration, the movement (rotation) of the second operation arm constituting the assist mechanism is kept from being constrained by the steering mechanism. Therefore, the assist steering force of the assist mechanism can be effectively applied to the steered wheel.

Additionally, the bogie may include a rotation spring that is biased in a direction in which the guide device is returned to a straight-running state, and a turning damper that attenuates the rocking of the guide device in a rotational direction by the rotation spring.

In this case, even if the guide device turns under the reaction force when the bogie travels along the linear portion of the track, the guide device can be more rapidly returned to the straight-running state by the rotation spring and the turning damper. Therefore, the bogie can travel in a more stable state in the linear portion of the track.

According to a sixth aspect of the invention, a track-type vehicle includes the bogie of any one aspect of the first to fifth aspects; and a vehicle body that is supported by the bogie.

Advantageous Effects of Invention

According to the above-described traveling bogie, the wide steered wheel can be steered while suppressing the reaction force that the guide device receives from the guide rail to be small.

DESCRIPTION OF EMBODIMENTS

Hereinafter, a first embodiment of the invention will be described with reference to FIGS. 1 to 6.

Figure 1:
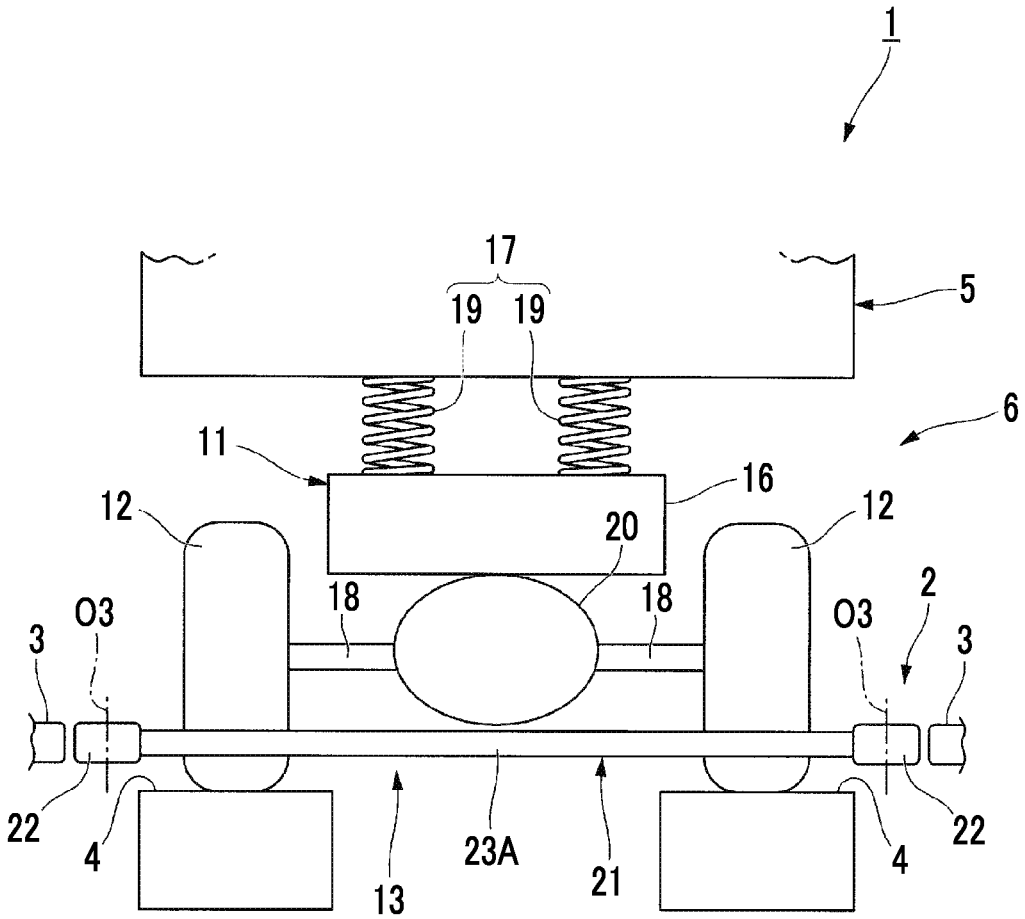
FIG. 1 is a front view illustrating a track-type vehicle related to a first embodiment of the invention.
Figure 2:
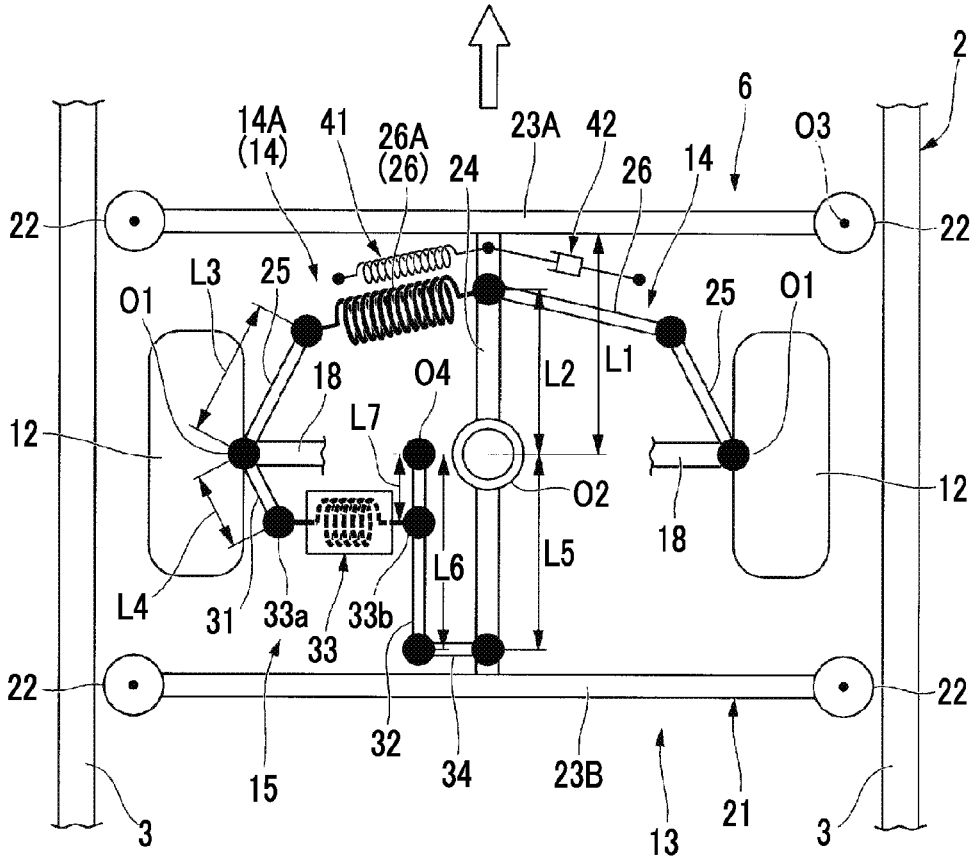
FIG. 2 is a top view illustrating the track-type vehicle of FIG. 1.

As illustrated in FIGS. 1 and 2, a track-type vehicle 1 (hereinafter simply referred to as a vehicle 1) in the present embodiment is guided by so-called side-guide type guide rails 3 that are provided at both side parts of a track 2 in a width direction and travels on traveling paths 4 of the track 2.

The vehicle 1 includes a vehicle body 5 and bogies 6. The vehicle body 5 has a hollow, substantially rectangular parallelepiped shape that is long back and forth in a traveling direction. A space where passengers can be accommodated is formed inside the vehicle body 5.

The bogies 6 support the vehicle body 5 from below, and travel on the track 2. The bogies 6 are arranged below a front part and a rear part of the vehicle body 5. The bogies 6 only have a difference in whether each traveling bogie is arranged at the front part of the vehicle body 5 or is arranged at the rear part. For this reason, in the following description, a bogie 6 arranged at the front part of the vehicle body 5 will be described.

The bogie 6 includes a main body 11, steered wheels 12, a guide device 13, and steering mechanisms 14. The main body 11 supports the vehicle body 5 from below. The main body 11 includes a bogie frame 16, a shock absorber 17, and an axle 18.

The shock absorber 17 is provided between the vehicle body 5 and the bogie frame 16. The shock absorber 17 prevents the vibration caused by the irregularities or the like on a road surface in the traveling paths 4 from being transmitted to the vehicle body 5. The shock absorber 17 includes, for example, spring members 19. Two spring members 19 are disposed, for example, at a distance from each other in the vehicle width direction of the vehicle body 5. The spring members 19 may be, for example, air springs.

The axle 18 is supported by the bogie frame 16. The axle 18 extends to both sides in the vehicle width direction from a gear box 20 at a central part in a vehicle width direction. Mechanisms, such as a differential gear, which transmits the rotational power from a power source (not illustrated), such as a motor, to the axle 18, are housed in the gear box 20. In the illustrated example, the axle 18 is supported by the bogie frame 16 via the gear box 20 by the gear box 20 being fixed to the lower side of the bogie frame 16. However, the invention is not limit to this.

The steered wheels 12 are so-called wheels with a tire on which rubber tires are mounted. The steered wheels 12 are connected to both ends of each axle 18 extending to both sides in the vehicle width direction, and are configured so as to be rotatable around the axle 18 together with the axle 18. Accordingly, the vehicle 1 can travel on the traveling paths 4 of the track 2. Additionally, the steered wheels 12 are configured so as to be pivotable around steering shafts O1 (for example, kingpins) disposed at ends of the axle 18 on both sides in the vehicle width direction with respect to the main body 11. As the steered wheels 12 pivot around the steering shafts O1, the orientation of the vehicle 1 in the traveling direction can be changed.

The guide device 13 is disposed below the main body 11, and is supported so as to be turnable around the turning axis O2 extending in an upward-downward direction with respect to the main body 11. The guide device 13 turns under a reaction force from a guide rail 3. The guide device 13 includes a guide frame 21 and guide wheels 22.

The guide frame 21 includes lateral beams 23A and 23B and a longitudinal beam (turning arm) 24. The lateral beams 23A and 23B are formed to extend to both outer sides in the vehicle width direction more than the steered wheels 12. Additionally, the lateral beams 23A and 23B are respectively arranged in front of and behind the steered wheels 12 in the traveling direction. The longitudinal beam 24 extends in the traveling direction of the steered wheels 12, and connects the pair of front and rear lateral beams 23A and 23B at an intermediate portion thereof in the vehicle width direction. The longitudinal beam 24 is attached so as to be turnable around the turning axis O2 with respect to the main body 11 at the intermediate portion thereof in an extending direction.

The guide wheels 22 are guided by the guide rails 3 arranged on both sides of the track 2 in the vehicle width direction. The guide wheels 22 are attached to both ends of the respective lateral beams 23A and 23B, and are configured to be rotatable around axes O3 extending in the upward-downward direction. When the vehicle 1 travels on the track 2, the guide wheels 22 abut against the guide rails 3 and thereby roll along the guide rails 3.

In the guide device 13, the width dimension of the guide device 13 in the extending direction of the lateral beams 23A and 23B is set to be smaller than the dimension between the guide rails 3. Additionally, in the guide device 13, a guide wheel 22 is pressed against a guide rail 3, and thereby turning under a reaction force from the guide rail 3 (refer to FIG. 6).

The steering mechanisms 14 apply steering forces to the steered wheels 12 using the reaction force that the above-mentioned guide device 13 has received. The steering mechanisms 14 pivot the steered wheels 12 in the same direction as the turning direction of the guide device 13 around the steering shafts O1 when the guide device 13 is turned by coupling the guide device 13 and the steering shafts O1 of the steered wheels 12 to each other. A steering mechanism 14 is provided for each steered wheel 12. Each steering mechanism 14 includes a first coupling arm 25 and a second coupling arm 26.

A first end of the first coupling arm 25 in its longitudinal direction is attached so as to be pivotable around (the steering direction of each steered wheel 12) of each steering shaft O1 together with the steered wheel 12.

The second coupling arm 26 couples the first coupling arm 25, and the longitudinal beam 24 of the guide frame 21.

A first end of the second coupling arm 26 in its longitudinal direction is rotatably coupled to a second end of the first coupling arm 25. A second end of the second coupling arm 26 is rotatably coupled to the longitudinal beam 24 of the guide frame 21. A coupling portion of the longitudinal beam 24 with the second coupling arm 26 is located between the turning axis O2 and an end (a connection portion with the lateral beam 23A or 23B) of the longitudinal beam 24. In the illustrated example, a coupling portion between the first and second coupling arms 25 and 26 is located further to the front side in the traveling direction of the vehicle 1 (traveling bogie 6) than the steering shaft O1, and the coupling portion of the longitudinal beam 24 with the second coupling arm 26 is located further to the front side in the traveling direction of the vehicle 1 (traveling bogie 6) than the turning axis O2. However, the invention is not limited to this. For example, the coupling portion between the first and second coupling arms 25 and 26 may be located further to the rear side in the traveling direction of the vehicle 1 (traveling bogie 6) than the steering shaft O1, and the coupling portion of the longitudinal beam 24 with the second coupling arm 26 may be located further to the rear side in the traveling direction of the vehicle 1 (traveling bogie 6) than the turning axis O2.

Additionally, in one steering mechanism (the left in FIG. 2) 14A, a second coupling arm 26A is an elastic member that is elastically deformable. It is preferable that the elastic modulus of the second coupling arm 26A is set to be large so that the steering angle of the steered wheel 12 with respect to the turning angle of the guide device 13 is uniquely determined. Additionally, it is preferable that the elastic modulus of the second coupling arm 26A is set to be larger than the elastic modulus of an elastically deformable section of an assist mechanism to be described below.

In the steering mechanism 14 having the above configuration, the second coupling arm 26 is displaced when the guide device 13 turns around the turning axis O2 under a reaction force from a guide rail 3. Moreover, as the first coupling arm 25 pivots around the steering shaft O1, the steered wheel 12 is steered in a direction in the same direction as the turning direction of the guide device 13 (refer to FIG. 6). That is, the steering mechanism 14 applies a steering force to the steered wheel 12 using the reaction force that the guide device 13 receives, thereby steering the steered wheel 12 in the same direction as the turning direction of the guide device 13.

In a configuration in which the steering mechanism 14 is provided between the steered wheel 12 and the guide device 13 as described above, a first distance L1, a second distance L2, and a third distance L3 satisfy the following relationship. The first distance L1 is a distance from the turning axis O2 to the connection portion of the longitudinal beam 24 with the lateral beam 23A or 23B. The second distance L2 is a distance from the turning axis O2 to the coupling portion of the longitudinal beam 24 with the second coupling arm 26 (steering mechanism 14). The third distance L3 is a distance from the steering shaft O1 to the coupling portion of the first coupling arm 25 with the second coupling arm 26.

L1>L2

L2>L3

Moreover, the bogie 6 includes an assist mechanism 15 that applies an assist steering force, which assists the steering force applied by the above-mentioned steering mechanism 14, to the steered wheel 12. The assist mechanism 15 includes a first operation arm 31, a second operation arm 32, and an elastically deformable section 33.

A first end of the first operation arm 31 in its longitudinal direction is attached so as to be pivotable around the steering shaft O1 together with the steered wheel 12. The first operation arm 31 is provided so as to extend in a direction opposite to the first coupling arm 25 of the steering mechanism 14 from the steering shaft O1 regarding the traveling direction of the vehicle 1.

The second operation arm 32 is attached so as to be rotatable around a rotation axis O4 extending in the upward-downward direction with respect to the main body 11.

In the present embodiment, a first end of the second operation arm 32 in the longitudinal direction is attached so as to be rotatable around the rotation axis O4.

The second operation arm 32 is coupled to the guide device 13 so as to rotate around the rotation axis O4 according to the turning of the guide device 13. In the present embodiment, a second end of the second operation arm 32 is coupled to the longitudinal beam 24 of the guide frame 21. Moreover, in the present embodiment, the second end of the second operation arm 32 is coupled to the longitudinal beam 24 via a third operation arm 34. A first end of the third operation arm 34 is rotatably coupled to the second end of the second operation arm 32. A second end of the third operation arm 34 is rotatably coupled to the longitudinal beam 24.

A coupling portion of the longitudinal beam 24 with the second operation arm 32 is located between the turning axis O2 and the end (the connection portion with the lateral beam 23A or 23B) of the longitudinal beam 24. Additionally, the coupling portion of the longitudinal beam 24 with the second operation arm 32 is located so that the turning axis O2 is disposed between the coupling portion of the longitudinal beam 24 with the second coupling arm 26.

The elastically deformable section 33 is coupled to the first operation arm 31 and the second operation arm 32. The elastically deformable section 33 is elastically deformed with a change in relative distance between the first operation arm 31 and the second operation arm 32.

A first end 33*a* of the elastically deformable section 33 in its longitudinal direction is rotatably coupled to a second end of the first operation arm 31. A second end 33*b* of the elastically deformable section 33 is rotatably coupled to a portion of the second operation arm 32 apart from the rotation axis O4. In the present embodiment, a coupling portion of the second operation arm 32 with the elastically deformable section 33 is located between a coupling portion of the second operation arm 32 with the longitudinal beam 24, and the rotation axis O4.

Additionally, the elastically deformable section 33 of the present embodiment is configured so as not to be elastically deformed irrespective of a change in relative distance between the first operation arm 31 and the second operation arm 32, in a case where the steering angle of the steered wheel from a straight-running state is equal to or smaller than a predetermined angle.

Hereinafter, the specific configuration of the elastically deformable section 33 of the present embodiment will be described.

Figure 3:
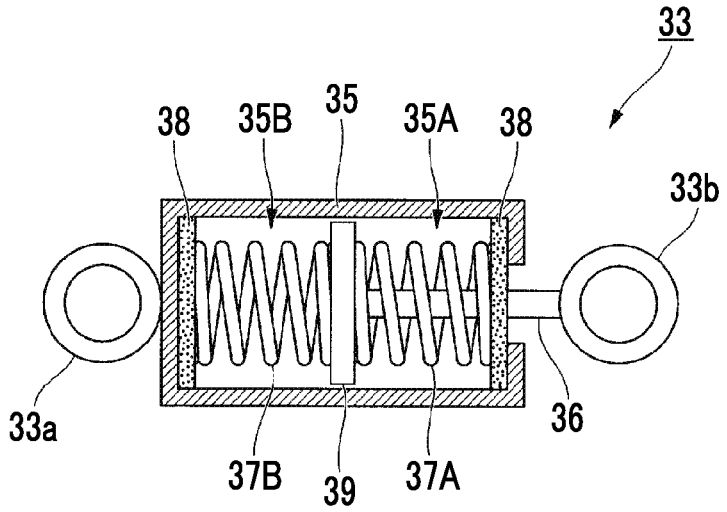
FIG. 3 is an enlarged sectional view illustrating an elastically deformable section of an assist mechanism that the track-type vehicle of FIGS. 1 and 2 includes.

The elastically deformable section 33, as illustrated in FIG. 3, includes a case 35, a piston rod 36, spring members 37A and 37B, and cushions 38. The case 35 is formed in a tubular shape.

A first end of the case 35 in its axial direction forms, for example, a first end 33*a* of the elastically deformable section 33.

The piston rod 36 protrudes from a second end of the case 35. The piston rod 36 is provided so as to be extendable and retractable with respect to the case 35. A tip of the piston rod 36 its protruding direction forms, for example, a second end 33*b* of the elastically deformable section 33. A base end of the piston rod 36 located inside the case 35 is provided with a partition plate 39 that splits the internal space of the case 35 in the axial direction of the case 35.

The spring members 37A and 37B are linear springs of which the elastic modulus is constant, for example like coil springs. The spring members 37A and 37B are disposed one by one in respective space portions 35A and 35B of the case 35 split by the partition plate 39. However, both ends of each of the spring members 37A and 37B are not fixed to an inner surface of the case 35, or the partition plate 39.

The cushions 38 have characteristics that the elastic modulus there is very small as compared to the spring members 37A and 37B, and elastic forces are hardly generated even if external forces are applied to the cushions. The cushions 38 are made of, for example, low-resilient urethane materials or the like. The cushions 38 are disposed one by one between the inner surface of the case 35 that faces the partition plate 39 and the respective spring members 37A and 37B.

Figure 4:
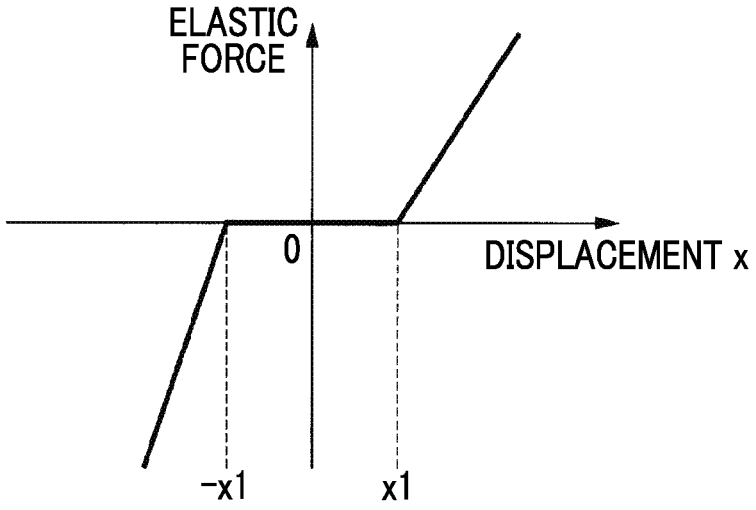
FIG. 4 is a graph illustrating the elastic force characteristics of the elastically deformable section of FIG. 3.

The elastically deformable section 33 of the present embodiment configured as described above has elastic force characteristics illustrated in FIG. 4. Hereinafter, the elastic force characteristics will be specifically described with reference to FIGS. 3 and 4.

For example, when the piston rod 36 is displaced up to a predetermined displacement x1 in a direction in which the piston rod is extended with respect to the case 35, only a cushion 38 between the first spring member 37A and the inner surface of the case 35 is compressively deformed, and the first spring member 37A is not elastically deformed. Then, if the piston rod 36 is displaced to be larger than the predetermined displacement x1, the cushion 38 is completely crushed and is not compressively deformed. Therefore, the first spring member 37A is compressed and is elastically deformed. In this case, the second spring member 37B is not elastically deformed. Accordingly, in the elastically deformable section 33, an elastic force in a direction in which the piston rod 36 is retracted is generated with the elastic deformation of the first spring member 37A.

On the other hand, when the piston rod 36 is displaced up to a predetermined displacement −x1 in a direction in which the piston rod is retracted with respect to the case 35, only a cushion 38 between the second spring member 37B and the inner surface of the case 35 is deformed, and the second spring member 37B is not elastically deformed. Then, if the piston rod 36 is displaced to be larger than the predetermined displacement −x1, the cushion 38 is completely crushed and is not compressively deformed. Therefore, the second spring member 37B is compressed and is elastically deformed. In this case, the first spring member 37A is not elastically deformed. Accordingly, in the elastically deformable section 33, an elastic force in a direction in which the piston rod 36 is extended is generated with the elastic deformation of the second spring member 37B.

The above-described elastic forces of the elastically deformable section 33 are transmitted to the steered wheel 12 via the first operation arm 31, and are applied to the steered wheel 12 as an assist steering force.

The displacement of the elastically deformable section 33 having the above characteristics is set so as to correspond to the steering angle of the steered wheel 12, on the basis of the orientation of the steered wheel 12 that is brought into the straight-running state. That is, in a case where the steered wheel 12 is in the straight-running state, the displacement of the elastically deformable section 33 is set to reach 0. Additionally, in a case where the steering angle of the steered wheel 12 has a predetermined angle, the displacement of the elastically deformable section 33 is set to reach the predetermined displacement x1 or −x1.

In the present embodiment, the assist mechanism 15 having the above configuration is provided only between one steered wheel 12 and the guide device 13 (on the left in FIG. 2). However, the assist steering force of the elastically deformable section 33 is also applied to the other steered wheel 12 via the steering mechanism 14A coupled to the one steered wheel 12, the longitudinal beam 24, and the steering mechanism 14 coupled to the other steered wheel 12.

As illustrated in FIG. 2, in the bogie 6 provided with the assist mechanism 15 as described above, the first distance L1 and the second distance L2 in the longitudinal beam 24, and the third distance L3, a fourth distance L4, a fifth distance L5, a sixth distance L6, and a seventh distance L7 in the first coupling arm 25, satisfy the following relationship. The fourth distance L4 is a distance from the steering shaft O1 to a coupling portion of the first operation arm 31 with the elastically deformable section 33. The fifth distance L5 is a distance from the turning axis O2 to the coupling portion of the longitudinal beam 24 with the second operation arm 32. The sixth distance L6 is a distance from the rotation axis O4 to the coupling portion of the second operation arm 32 with the longitudinal beam 24. The seventh distance L7 is a distance from the rotation axis O4 to the coupling portion of the second operation arm 32 with the elastically deformable section 33.

$$L3>L4$$

$$L1>L5$$

$$L6>L7$$

$$L7>L4$$

$$L2<L5$$

Moreover, the bogie 6 of the present embodiment includes a rotation spring 41 and a turning damper 42. The rotation spring 41 is provided between the main body 11 and the guide device 13 (guide frame 21), and is biased in a direction in which the guide device 13 is returned to the straight-running state. The rotation spring 41 is elastically deformed when the guide device 13 turns with respect to the main body 11, and is biased in the direction in which the guide device 13 is returned to the straight-running state. The turning damper 42 is provided between the main body 11 and the guide device 13 (guide frame 21), and attenuates the rocking of the guide device 13 in the turning direction by the rotation spring 41.

In the bogie 6 of the present embodiment, respective first ends of the rotation spring 41 and the turning damper 42 in the longitudinal direction are rotatably coupled to the main body 11. Respective second end of the rotation spring 41 and the turning damper 42 are rotatably coupled to the portion of the guide devices 13 away from the turning axis O2.

In the illustrated example, the respective second ends of the rotation spring 41 and the turning damper 42 are coupled to the longitudinal beam 24, but may be coupled to, for example, the lateral beams 23A and 23B. Additionally, in the illustrated example, the coupling portions between the guide device 13 and the respective second ends of the rotation spring 41 and the turning damper 42 are located further to the front side in the traveling direction of the vehicle 1 (traveling bogie 6) than the turning axis O2. However, for example, the coupling portions may be located further to the rear side in the traveling direction of the vehicle 1 (traveling bogie 6) than the turning axis O2. Moreover, in the illustrated example, the rotation spring 41 is disposed on one side in the vehicle width direction with respect to the longitudinal beam 24, and the turning damper 42 is disposed on the other side in the vehicle width direction with respect to the longitudinal beam 24. However, for example, both the rotation spring 41 and the turning damper 42 may be collectively disposed on one side or the other side in the vehicle width direction with respect to the longitudinal beam 24.

Next, the operation of the vehicle 1 of the present embodiment configured as described above will be described.

Figure 5:
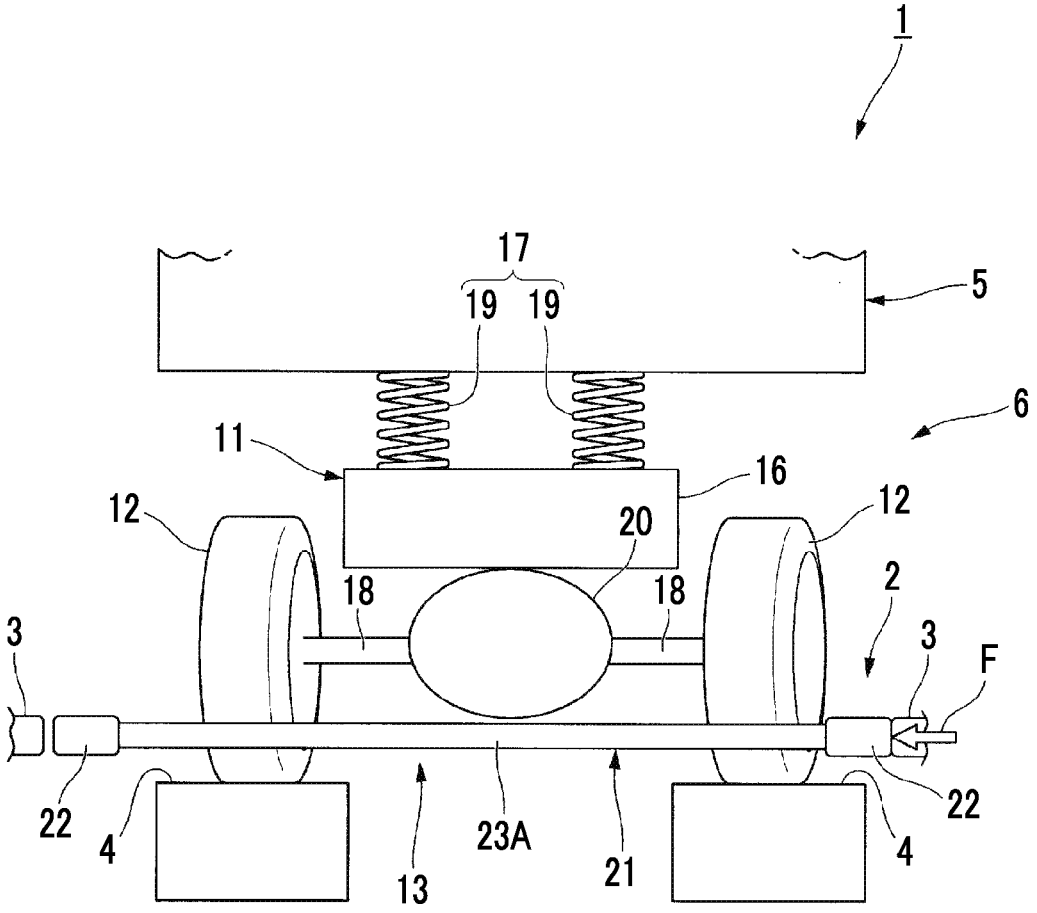
FIG. 5 is a front view illustrating a state where the track-type vehicle of FIGS. 1 and 2 is traveling along a curved portion of a track.
Figure 6:
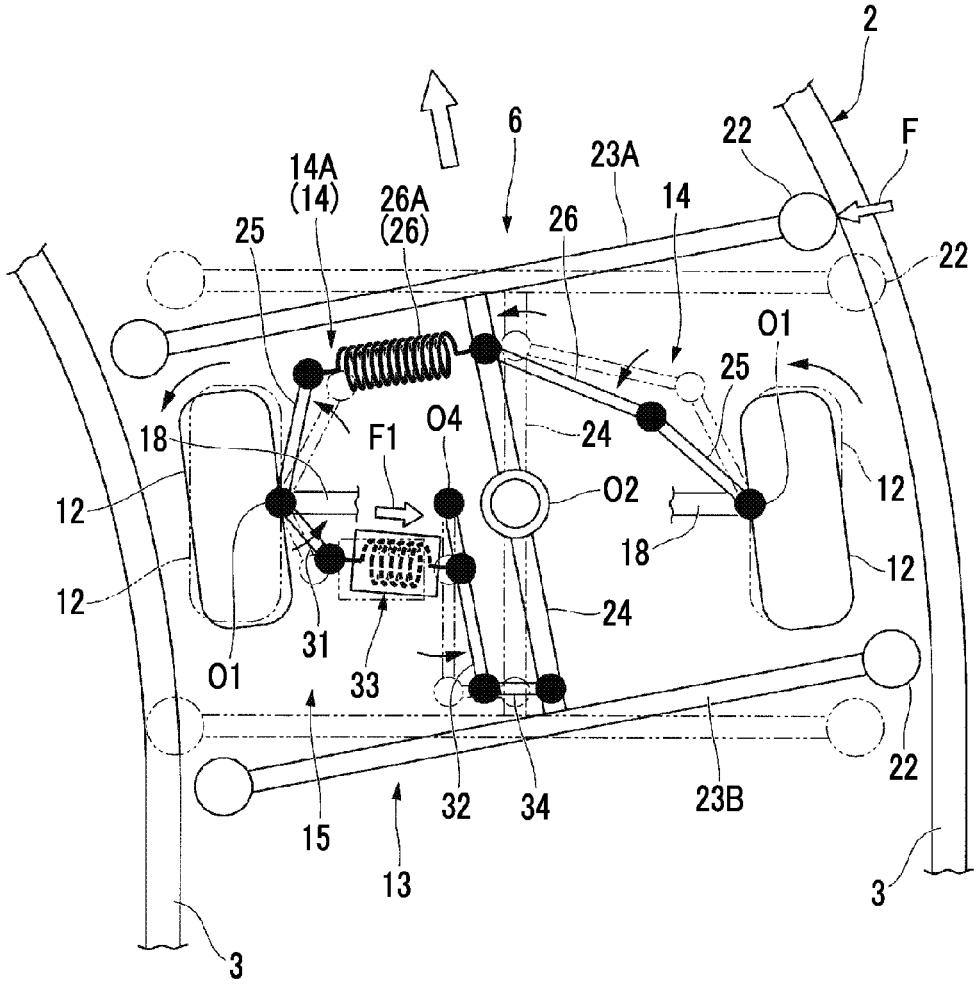
FIG. 6 is a top view illustrating a state where the track-type vehicle of FIGS. 1 and 2 is traveling along the curved portion of the track.

As illustrated in FIGS. 5 and 6, when the vehicle 1 is traveling along a curved portion of the track 2, mainly a guide wheel 22 on a front outer rail side in the guide wheels 22 of the guide device 13 receive a reaction force F from an outer side in the vehicle width direction, from a guide rail 3 disposed on an outer rail side of the curved portion. The guide device 13 turns around the turning axis O2 so that the front side (lateral beam 23A side) of the guide device 13 approaches a guide rail 3 on an inner rail side, on the basis of this reaction force F. Additionally, a steering force using the aforementioned reaction force F is applied to the steered wheel 12 by the steering mechanism 14 with the turning of the guide device 13, and the steered wheel 12 is steered in the same direction as the turning direction of the guide device 13 around the steering shaft O1. That is, the steered wheel 12 can be directed to the traveling direction of the vehicle 1 along the curved portion of the track 2. Accordingly, the vehicle 1 travels along the curved portion of the track 2.

When the vehicle 1 travels along the curved portion of the track 2 as described above, the steering angle of the steered wheel 12 steered becomes equal to more than a predetermined angle. When the steered wheel 12 is steered in the curved portion of the track 2, the assist steering force applied by the assist mechanism 15 is also applied to the steered wheel 12. This will be specifically described below.

When the guide device 13 turns under the reaction force F from the guide rail 3, a force (rotative force) that rotates the second operation arm 32 around the rotation axis O4 is applied to the second operation arm 32. Here, the sixth distance L6 in the second operation arm 32 is longer than the seventh distance L7 in the second operation arm 32. For this reason, when the second operation arm 32 rotates and the relative distance between the second operation arm 32 and the first operation arm 31 varies, a greater force than the above rotative force acts on the elastically deformable section 33, and the elastically deformable section 33 is elastically deformed. Accordingly, an elastic force F1 of the elastically deformable section 33 that has been elastically deformed becomes greater than the rotative force that acts on the second operation arm 32. That is, the second operation arm 32 constitutes a so-called "lever". In the second operation arm 32, the rotation axis O4 becomes a fulcrum of the "lever", the coupling portion with the guide device 13 becomes a point of effort of the "lever", and the coupling portion with the elastically deformable section 33 becomes a working point of the "lever".

The elastic force F1 of the elastically deformable section 33 is transmitted to the first operation arm 31. Here, since the steered wheel 12 is steered by the steering mechanism 14 as described above, the first operation arm 31 is also pivoted around a steering shaft O1 with this steering. Additionally, as the first to seventh distances L1 to L7 are appropriately set, the elastic force F1 of the elastically deformable section 33 acts in the steering direction of the steered wheel 12. That is, the elastic force F1 of the elastically deformable section 33 is applied to the steered wheel 12 as the assist steering force.

As described above, according to the vehicle 1 including the bogie 6 of the present embodiment, when the steered wheel 12 is steered by the steering mechanism 14, the assist steering force applied by the assist mechanism 15 is also applied to the steered wheel 12. For this reason, it is possible to steer the steered wheel 12 while suppressing the reaction force that the guide device 13 receives from the guide rail 3 to be small, even if the steered wheel 12 is wide. Therefore, the vehicle 1 that can cope with an increase in withstand load and an increase in the speed of the track-based transportation system can be provided.

Additionally, the reaction force of the assist steering force (elastic force F1) that the second operation arm 32 receives from the elastically deformable section 33 is received by the main body 11 via the rotation axis O4 of the second operation arm 32. For this reason, the assist steering force can be efficiently applied to the steered wheel 12 while reducing the reaction force that the guide device 13 receives from the guide rail 3.

Moreover, according to the bogie 6 and the vehicle 1 of the present embodiment, the coupling portion (working point of a "lever") of the second operation arm 32 with the elastically deformable section 33 is located between the coupling portion (the point of effort of the "lever") of the second operation arm 32 with the guide device 13 and the rotation axis O4 (the fulcrum of the "lever"). For this reason, as compared to a configuration in which the second operation arm 32, and the elastically deformable section 33 and the guide device 13 are coupled, respectively, so that the fulcrum of the "lever" may be located between the working point and point of effort, the length of the second operation arm 32 can be short set, and miniaturization of the assist mechanism 15 can be achieved.

Additionally, according to the bogie 6 and the vehicle 1 of the present embodiment, the fifth distance L5 in the longitudinal beam 24 is longer than the second distance L2. Therefore, the movement of the second operation arm 32 with respect to the turning angle of the longitudinal beam 24 becomes greater than the movement of the steering mechanism 14. For this reason, it is possible to set the assist steering force applied by the assist mechanism 15 to be larger. Therefore, the steered wheel 12 can be steered, while suppressing the reaction force that the guide device 13 receives from the guide rail 3 to be smaller.

Moreover, as the movement of the steering mechanism 14 with respect to the turning angle of the longitudinal beam 24 becomes small, it is also possible to precisely adjust the steering angle of the steered wheel 12.

Additionally, in the bogie 6 and the vehicle 1 of the present embodiment, if the guide device 13 receives a minute reaction force from the guide rail 3 and the steering angle of the steered wheel 12 accompanying this is equal to or smaller than a predetermined angle when the bogie 6 travels along the linear portion of a track 2, the elastically deformable section 33 is not elastically deformed even if the second operation arm 32 rotates around the rotation axis O4. For this reason, the assist steering force is not applied to the steered wheel 12. For this reason, even if the guide device 13 receives the minute reaction force and the steered wheel 12 is steered when the vehicle 1 travels along the linear portion of the track 2, it is possible to return the steered wheel 12 to the straight-running state rapidly with self-aligning torque. Therefore, the vehicle 1 can travel along the linear portion of the track 2 in a stable state.

Moreover, in the present embodiment, the second coupling arm 26A of one steering mechanism 14A is made of an elastic member. Therefore, the movement (rotation) of the second operation arm 32 constituting the assist mechanism 15 is kept from is constrained by the steering mechanism 14. For this reason, the assist steering force of the assist mechanism 15 can be effectively applied to the steered wheel 12.

Additionally, the bogie 6 and the vehicle 1 of the present embodiment include the rotation spring 41 and the turning damper 42. For this reason, even if the guide device 13 turns under the reaction force when the bogie 6 travels along the linear portion of the track 2, the guide device 13 can be more rapidly returned to the straight-running state by the rotation spring 41 and the turning damper 42. Therefore, the bogie 6 is enabled to travel in a more stable state in the linear portion of the track 2.

Although the invention has been described above in detail, the invention is not limited to the above-described embodiment, and various changes can be made without departing from the scope of the invention.

For example, the assist mechanism 15 is not limited to being provided only between one steered wheel 12 and the guide device 13, and assist mechanisms are respectively provided between both the steered wheels 12 and the guide device 13.

Additionally, in the assist mechanism 15, the position of the coupling portion of the second operation arm 32 with the elastically deformable section 33 is not limited to being set like the above embodiment. The above position of the coupling portion may be set to, for example, a position where the rotation axis O4 is disposed between the coupling portion of the second operation arm 32 with the longitudinal beam 24 so that at least the seventh distance L7 in the second operation arm 32 becomes shorter than the sixth distance L6.

Moreover, the elastically deformable section 33 having characteristics of being not elastically deformed in a case where the steering angle of the steered wheel 12 from the straight-running state is equal to or smaller than a predetermined angle may be arbitrarily configured without being limited to being configured like the above embodiment.

Additionally, the elastically deformable section 33 is not limited to being configured so as not to be elastically deformed in a case where the steering angle of the steered wheel 12 from a straight-running state is equal to or smaller than a predetermined angle. For example, the elastically deformable section may be configured so as to be elastically deformed when the steered wheel 12 is steered from the straight-running state. In this case, the elastically deformable section 33 may have, for example, a configuration in which the cushions 38 are eliminated. Additionally, the elastically deformable section 33 may be constituted of, for example, only spring member, such as one coil spring.

Additionally, the invention is not limited to the bogie 6 that travels while being guided by the side guide type guide rails 3 provided at both ends of the track 2 in the width direction like the above embodiment. For example, the invention is also applicable to a bogie that travels while being guided by a center guide type guide rail provided at a central part in the track width direction.

INDUSTRIAL APPLICABILITY

According to this traveling bogie, the wide steered wheel can be steered while suppressing the reaction force that the guide device receives from the guide rail to be small.

REFERENCE SIGNS LIST

1: TRACK-TYPE VEHICLE
2: TRACK
3: GUIDE RAIL
5: VEHICLE BODY
6: TRAVELING BOGIE
11: MAIN BODY
12: STEERED WHEEL
13: GUIDE DEVICE
14, 14A: STEERING MECHANISM
15: ASSIST MECHANISM,
24: LONGITUDINAL BEAM (TURNING ARM)
26A: SECOND COUPLING ARM (ELASTIC MEMBER)
31: FIRST OPERATION ARM
32: SECOND OPERATION ARM
33: ELASTICALLY DEFORMABLE SECTION
35: CASE
36: PISTON ROD
37A, 37B: SPRING MEMBER
38: CUSHION
L2: SECOND DISTANCE
L5: FIFTH DISTANCE
L6: SIXTH DISTANCE
L7: SEVENTH DISTANCE
O2: TURNING AXIS
O4: ROTATION AXIS

The invention claimed is:

1. A bogie that travels while being guided by a guide rail provided along a track, the bogie comprising:

a steered wheel;

a main body that supports the steered wheel;

a guide device that is supported so as to be rotatable with respect to the main body and turns under a reaction force from the guide rail;

a steering mechanism that applies a steering force to the steered wheel using the reaction force that the guide device has received; and an assist mechanism that applies an assist steering force, which assists the steering force applied by the steering mechanism, to the steered wheel, wherein the assist mechanism includes a first operation arm that pivots in a steering direction of the steered wheel together with the steered wheel, a second operation arm that is attached so as to be rotatable around a rotation axis with respect to the main body, is coupled to the guide device, and rotates around the rotation axis according to the turning of the guide device, and an elastically deformable section that is coupled to the first operation arm and the second operation arm and is elastically deformable with a change in relative distance between the first operation arm and the second operation arm, and wherein a distance from the rotation axis to a coupling portion of the second operation arm with the guide device is longer than a distance from the rotation axis to a coupling portion of the second operation arm with the elastically deformable section.

2. The according to claim 1, wherein a coupling portion of the second operation arm with the elastically deformable section is located between a coupling portion of the second operation arm with the guide device, and the rotation axis.

3. The according to claim 1, wherein the guide device further includes a turning arm that is attached so as to be turnable around a turning axis with respect to the main body, and wherein a distance from the turning axis to a coupling portion of the turning arm with the second operation arm is longer than a distance from the turning axis to a coupling portion of the turning arm with the steering mechanism.

4. The according to claim 1, wherein the elastically deformable section is not elastically deformed in a case where the steering angle of the steered wheel from a straight-running state is equal to or smaller than a predetermined angle.

5. The according to claim 1, wherein the steering mechanism includes an elastic member that couples the steered wheel and the guide device, and is elastically deformable.

6. A track-type vehicle comprising:

the bogie according to claim 1; and a vehicle body that is supported by the bogie.

* * * * *